US005225006A

United States Patent [19]

Sawa et al.

[11] Patent Number: 5,225,006

[45] Date of Patent: Jul. 6, 1993

[54] FE-BASED SOFT MAGNETIC ALLOY

[75] Inventors: Takao Sawa; Masami Okamura, both of Kanagawa, Japan

[73] Assignee: Kabushiki Kaisha Toshiba, Kawasaki, Japan

[21] Appl. No.: 713,592

[22] Filed: Jun. 11, 1991

Related U.S. Application Data

[63] Continuation of Ser. No. 353,064, May 17, 1989, abandoned.

[30] Foreign Application Priority Data

May 17, 1988 [JP] Japan ..... 63-118331

[51] Int. Cl.[5] ..... C22C 38/16; C22C 45/02

[52] U.S. Cl. ..... 148/304; 148/307

[58] Field of Search ..... 148/304, 306–311; 420/93

[56] References Cited

U.S. PATENT DOCUMENTS

| | | | |
|---|---|---|---|
| 4,881,989 | 11/1989 | Yoshizawa et al. | 148/307 |
| 4,918,555 | 4/1990 | Yoshizawa et al. | 148/307 |
| 5,069,731 | 12/1991 | Yoshizawa et al. | 148/306 |
| 5,084,795 | 1/1992 | Sakakima et al. | 148/306 |

FOREIGN PATENT DOCUMENTS

| | | | |
|---|---|---|---|
| 159027 | 10/1985 | European Pat. Off. | 148/309 |
| 92306 | 4/1987 | Japan . | |
| 241135 | 10/1988 | Japan . | |
| 68446 | 3/1989 | Japan . | |

*Primary Examiner*—George Wyszomierski
*Attorney, Agent, or Firm*—Foley & Lardner

[57] ABSTRACT

Fe-based soft magnetic alloy having excellent soft magnetic characteristics with high saturated magnetic flux density, characterized in that it has fine crystal grains and is expressed by the general formula:

$$Fe_{100-a-b-c-d}\,M_a\,M'_b\,Y_c\,N_d$$

where M is at one or more selected from Cu, Ag, Au, Zn, Sn, Pb, Sb, and Bi;

M′ is at least one or more selected from the elements of Groups IVa, Va, VIa of the periodic table, or Mn, Co, Ni, and Al, Y is at least one or more selected from Si, P, or B, and wherein "a", "b", "c" and "d" expressed in at. % are as follows:

$0.01 \leqq a \leqq 5$ $0.1 \leqq b \leqq 10$ $15 \leqq c \leqq 28$ $0 < d \leqq 8.$ A method is also provided treating the alloy to segregate fine crystal grains. The method involves heat treating the alloy for from one minute to ten hours at a temperature of from 50° C. below to 120° C. above the crystallization temperature of said alloy.

21 Claims, 1 Drawing Sheet

FE-BASED SOFT MAGNETIC ALLOY

This application is a continuation of application Ser. No. 07/353,064, filed May 17, 1989, abandoned.

BACKGROUND OF THE INVENTION

This invention relates to Fe-based, soft magnetic alloys.

Conventionally, iron cores of crystalline materials such as permalloy or ferrite have been employed in high frequency devices such as switching regulators. However, the resistivity of permalloy is low, so it is subject to large core loss at high frequency. Also, although the core loss of ferrite at high frequencies is small, the magnetic flux density is also small, at best 5,000 G. Consequently, in use at high operating magnetic flux densities, ferrite becomes close to saturation and as a result the core loss is increased.

Recently, it has become desirable to reduce the size of transformers that are used at high frequency, such as the power transformers employed in switching regulators, smoothing choke coils, and common mode choke coils. However, when the size is reduced, the operating magnetic flux density must be increased, so the increase in core loss of the ferrite becomes a serious practical problem.

For this reason, amorphous magnetic alloys, i.e., alloys without a crystal structure, have recently attracted attention and have to some extent been used because they have excellent soft magnetic properties such as high permeability and low coercive force. Such amorphous magnetic alloys are typically base alloys of Fe, Co, Ni, etc., and contain metalloids as elements promoting the amorphous state, (P, C, B, Si, Al, and Ge, etc.).

However, not all of these amorphous magnetic alloys have low core loss in the high frequency region. Iron-based amorphous alloys are cheap and have extremely small core loss, about one quarter that of silicon steel, in the frequency region of 50 to 60 Hz. However, they are extremely unsuitable for use in the high frequency region for such applications as in switching regulators, because they have an extremely large core loss in the high frequency region of 10 to 50 kHz. In order to overcome this disadvantage, attempts have been made to lower the magnetostriction, lower the core loss, and increase the permeability by replacing some of the Fe with non-magnetic metals such as Nb, Mo, or Cr. However, the deterioration of magnetic properties due to hardening, shrinkage, etc., of resin, for example, on resin molding, is large compared to Co-based alloys, so satisfactory performance of such of such materials is not obtained when used in the high frequency region.

Co-based, amorphous alloys also have been used in magnetic components for electronic devices such as saturable reactors, since they have low core loss and high squareness ratio in the high frequency region. However, the cost of Co-based alloys is comparatively high making such materials uneconomical.

As explained above, although Fe-based amorphous alloys constitute cheap soft magnetic materials and have comparatively large magnetostriction, they suffer from various problems when used in the high frequency region and are inferior to Co-based amorphous alloys in respect of both core loss and permeability. On the other hand, although Co-based amorphous alloys have excellent magnetic properties, they are not industrially practical due to the high cost of such materials.

SUMMARY OF THE INVENTION

Consequently, having regard to the above problems, the object of this invention is to provide an Fe-based, soft magnetic alloy having high saturation magnetic flux density in the high frequency region and with excellent soft magnetic characteristics.

According to the invention, there is provided an Fe-based soft magnetic alloy having fine crystal grains, as described in the following formula:

$$Fe_{100-a-b-c-d}\,M_a\,M'_b\,Y_c\,N_d$$

where "M" is at least one element selected from the group consisting of Cu, Ag, Au, Zn, Sn, Pb, Sb, and Bi; "M'" is at least one element selected from the group consisting of elements in Groups IVa, Va, VIa of the periodic table, Mn, Co, Ni, and Al; "Y" is at least one element selected from the group consisting of Si, P, and B; and wherein "a", "b", "c", and "d", expressed in at. % are as follows:

$$0.01 \leqq a \leqq 5$$

$$0.1 \leqq b \leqq 10$$

$$15 \leqq c \leqq 28$$

$$0 < d \leqq 8.$$

In a preferred embodiment, it is desirable that fine crystal grains are present in the alloy to the extent of 30% or more in terms of area ratio. It is further desirable that at least 80% of the fine crystal grains are of a crystal grain size of 50 Å to 300 Å. The term "area ratio" of the fine crystal grains as used herein means the ratio of the surface of the fine grains to the total surface in a plane of the alloy as measured, for example, by photomicrograph or by microscopic examination of ground and polished specimens.

Another aspect of the invention pertains to treating the alloy to segregate the fine crystal grains. This is advantageously achieved by heat treating the alloy for from one minute to ten hours at a temperature of from 50° C. below to 120° C. above the crystallization temperature of the alloy.

DETAILED DESCRIPTION OF THE PREFERRED EMBODIMENTS

Figure 1:
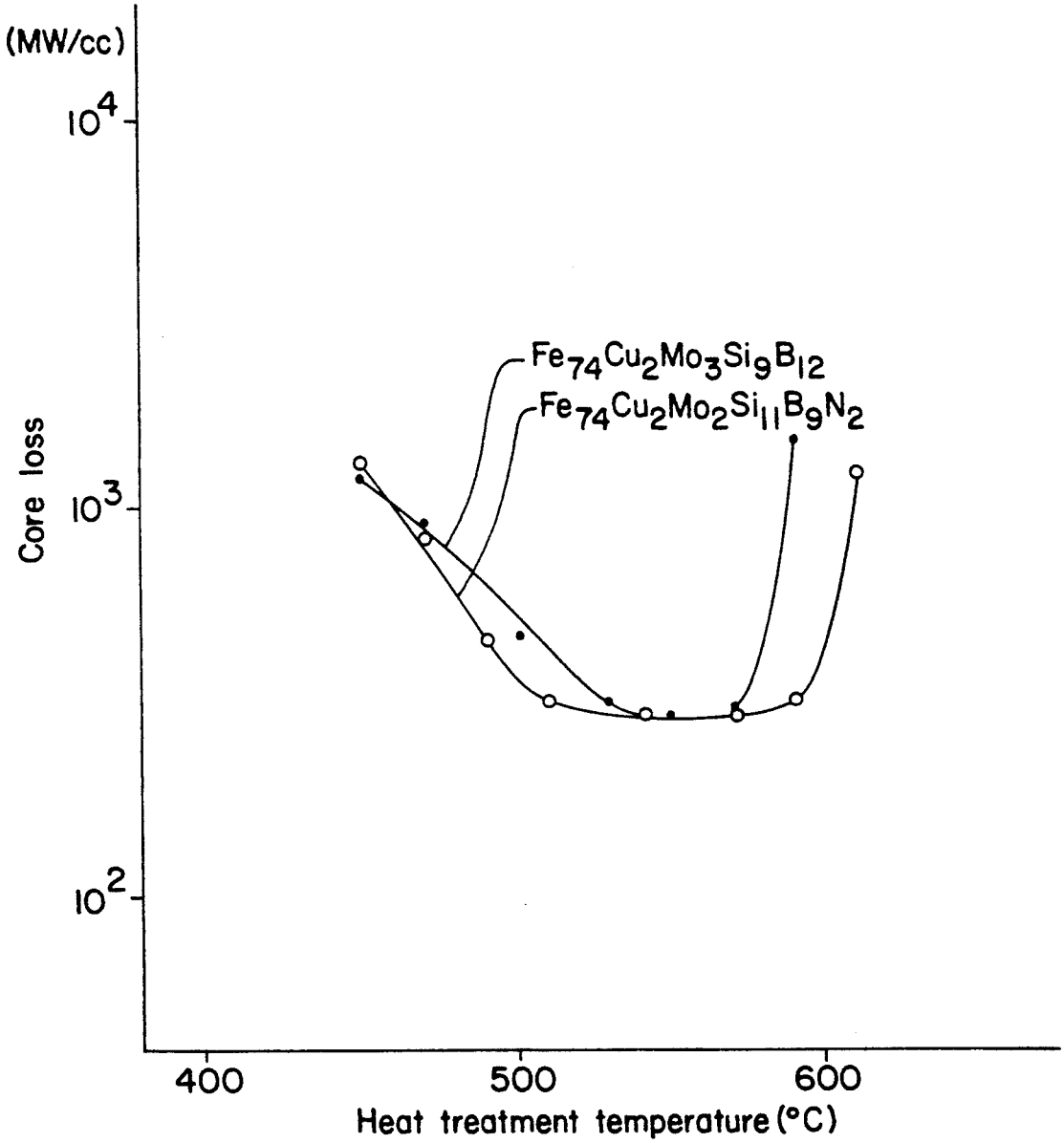
FIG. 1 is a graph showing the variation in core loss with variation of heat treatment temperature of the alloy of the invention and of the alloy of a comparative example.

In order to obtain the desired composition of the alloy of the invention, it is necessary that the composition thereof be balanced and within the limits as hereinafter discussed.

An alloy in accordance with the invention contains: Fe; N; at least one of Cu, Ag, Au, Zn, Pb, Sb, and Bi; at least one element from Groups IVa, Va and VIa of the period table, Mn, Co, Ni, and Al; and at least one of Si, P, and B; in accordance with the formula:

$$Fe_{100-a-b-c-d}\,M_a\,M'_b\,Y_c\,N_d$$

where "M" is at least one element selected from the group consisting of Cu, Ag, Au, Zn, Sn, Pb, Sb, and Bi; "M'" is at least one element selected from group consisting of Groups IVa, Va, VIa of the periodic table, Mn, Co, Ni, and Al; "Y" is at least one element selected from the group consisting of Si, P, or B; and wherein "a", "b", "c", and "d" expressed in at. % are as follows:

$$0.01 \leqq a \leqq 5$$

$$0.1 \leqq b \leqq 10$$

$$15 \leqq c \leqq 28$$

$$0 < d \leqq 8.$$

It is important that the alloy of the invention contain the aforesaid components in the amounts described in order to obtain the advantageous characteristics of the new alloy.

"M" is at least one element from the group consisting of Cu, Ag, Au, Zn, Sn, Pb, Sb and Bi. These elements are effective in increasing corrosion resistance, preventing coarsening of the crystal grains, and in improving soft magnetic properties such as core loss and permeability. However, if there is too little, the benefit of its addition is not obtained. On the other hand, if there is too much "M", deterioration of magnetic properties results. A range of 0.01 to 5 at. % is therefore selected. Preferably the amount is 0.5 to 3 at. %.

"M'" is an element that is effective in making the crystal grain size uniform and in improving the soft magnetic properties by reducing magnetostriction and magnetic anisotropy. It is also effective in improving the magnetic properties in respect of temperature change. However, if the amount of "M'" is too small, the benefit of the addition is not obtained. On the other hand, if the amount is too large, the saturation magnetic flux density is lowered. An amount of "M'" in the range of 0.1 to 10 at. % is therefore selected. Preferably the amount is 1 to 7 at. % and even more preferably 1.5 to 5 at. %.

In addition to the above-mentioned effects, the various additive elements in M' have the following respective effects: in the case of Group IVa elements, increase of the range of heat treatment conditions for obtaining optimum magnetic properties; in the case of Group Va elements and Mn, increase in resistance to embrittlement and increase in workability such as by cutting; in the case of the Group VIa elements, improvement of corrosion resistance and surface shape; in the case of Al, increased fineness of the crystal grains and reduction of magnetic anisotropy, thereby improving magnetostriction and soft magnetic properties.

"Y" are elements that are effective in making the alloy amorphous during manufacture, or in directly segregating fine crystals. If the amount is too small, the benefit of superquenching in manufacture is difficult to obtain and the above condition is not obtained. On the other hand, if the amount of "Y" is too great, the saturation magnetic flux density becomes low, also making the above condition difficult to obtain, with the result that superior magnetic properties are not obtained. An amount in the range 15 to 28 at. % is therefore selected. Preferably the range is 18 to 26 at. %. In particular, the ratio of Si/B or Si/P is preferably more than 1.

Nitrogen is included because it is effective in expanding the range of heat treatment conditions in order to obtain optimum magnetic properties. However, if there is too much N, fine crystals are difficult to obtain, so the amount is specified as being less than 8 at. %. Preferably it is less than 6 at. %, and even more preferably less than 4 at. %.

The Fe-based soft magnetic alloy of this invention may be obtained by the following method:

An amorphous alloy thin strip is obtained by liquid quenching, then heat treated for one minute to ten hours, preferably ten minutes to five hours at a temperature of 50° C. below to 120° C. above the crystallization temperature of the amorphous alloy, preferably 30° C. below to 100° C. above, to segregate the required fine crystals. Alternatively, direct segregation of the fine crystals can be accomplished by controlling quenching rate in the liquid quenching method.

It has also been determined that if there are few too fine crystal grains in the alloy of this invention, i.e., if there is too much amorphous phase, the core loss tends to become large, the permeability becomes low, the magnetostriction becomes large, and there is increased deterioration of the magnetic properties due to the resin moulding. It is thus preferable that there should be at least 30%, in terms of area ratio, of fine crystal grains in the alloy. More preferably, there should be at least 40%, and still more preferably at least 50%. Furthermore, it has been determined that if the size of the fine crystal grains is too small, the maximum improvement in magnetic properties is not obtained, while if it is too large, the magnetic properties are adversely affected. Consequently, it is desirable that at least 80% of the fine crystal grains should consist of crystals of crystal grain size 50 Å to 300 Å.

The Fe-based soft magnetic alloy of this invention has excellent soft magnetic properties at high frequency. It shows excellent properties as an alloy for magnetic materials for magnetic components such as magnetic cores used at radio frequency, such as, for example, magnetic heads, thin film heads, radio frequency transformers including transformers for high power use, saturable reactors, common mode choke coils, normal mode choke coils, high voltage pulse noise filters, and magnetic switches used in laser power sources, etc., and for sensors of various types, such as power source sensors, directions sensors, and security sensors, etc.

EXAMPLES

An amorphous alloy thin strip of thickness 15 μm was obtained by the single roll method from an alloy consisting of $Fe_{74}Cu_2Mo_2Si_{11}B_9N_2$. This amorphous alloy was then wound to form a toroidal core of external diameter 18 mm, internal diameter 12 mm, and height 4.5 mm, then heat treated for about 90 minutes at about 550° C. The crystallization of this alloy was about 575° C. at a temperature rise rate of 10° C./min (measured with a rate of temperature rise of 10° C./min).

Fine crystal grains were present to the extent of about 85% with respect to the total area of the alloy in the magnetic core that was obtained. Of these, fine crystal grains of 50 Å top 300 Å represented about 90%.

Also, for comparison, a magnetic core was manufactured on which heat treatment was performed for about 40 minutes at about 450° C. It was found by TEM observation that fine crystal grains had not segregated in this magnetic core.

Comparing five samples of magnetic cores according to the invention in which fine crystal grains were present and five samples of the magnetic cores of the comparison sample in which fine crystal grains were not present, the core loss after heat treatment at 100 kHz, 2 kG and the core loss after epoxy coating, the magnetostriction, the permeability at 1 kHz 2 mOe, and the saturation magnetic flux density were measured. The mean values in each case are shown in Table I.

TABLE I

| Alloy Composition | Whether fine crystal grains are present | Core Loss (mw/cc) Before Moulding | Core Loss (mw/cc) After Moulding | Magnetostriction ($\times 10^{-6}$) | Permeability $\mu$1KHz ($\times 10^4$) | Saturation magnetic flux density (kG) |
|---|---|---|---|---|---|---|
| $Fe_{74}Cu_2Mo_2$ $Si_{11}B_9N_2$ | Yes | 280 | 570 | 2.0 | 12.8 | 13.4 |
| $Fe_{74}Cu_2Mo_2$ $Si_{11}B_9N_2$ | No | 1100 | 3600 | 20.5 | 1.0 | 13.1 |

As is clear from the above Table I, in comparison with the core loss of the magnetic core consisting of amorphous alloy thin strip of the same composition, the alloy of this invention, having fine crystal grains, shows excellent soft magnetic properties at high frequencies, high permeability, low core loss after resin moulding and low magnetostriction.

Using a U-function meter, the core loss of magnetic cores of the above alloy composition was also measured, for measurement conditions 100 kHz and 2kG, but using various heat treatment temperatures. The results are shown in FIG. 1. For comparison, the same measurements were performed on a magnetic core of $Fe_{74}Cu_2Mo_3Si_9B_{12}$, not containing N, manufactured in the same way. These results are also shown in FIG. 1.

It was found that, by introduction of N, the temperature range of heat treatment with which low core loss was obtained with the alloy of this invention was increased.

With the alloy of this invention, an Fe-based soft iron alloy can be provided having excellent soft magnetic properties, having fine crystal grains in the desired alloy composition, with high saturated magnetic flux density in the high frequency region, and the required Fe-based soft magnetic materials can be easily manufactured, owing to the wide temperature range of heat treatment possible.

The foregoing description and examples have been set forth merely to illustrate the invention and are not intended to be limiting. Since modifications of the described embodiments incorporating the spirit and substance of the invention may occur to persons skilled in the art, the scope of the invention should be limited solely with reference to the appended claims and equivalents, wherein:

What is claimed is:

1. An Fe-based soft magnetic alloy comprising fine crystal grains and amorphous regions, the composition of said alloy being described by the following formula:

$$Fe_{100-a-b-d-c}\,M_a\,M'_b\,Y_c\,N_4$$

where "M" is at least one element selected from the group consisting of Cu, Ag, Au, Zn, Sn, Pb, Sb, and Bi;

"M'" is at least one element selected from the group consisting of Groups IVa, Va, and VIa of the periodic table, Mn, Co, Ni, and Al;

"Y" is at least one element selected from the group consisting of Si, P, and B; and wherein "a", "b" and "c" expressed in atomic % are as follows:

$0.01 \leqq a \leqq 5$ $0.01 \leqq b \leqq 10$ $15 \leqq c \leqq 28$ $d \leqq 8$, and N is present in an amount sufficient to increase the range of heat treatment conditions within which fine crystal grains can be segregated as compared to an alloy having the same amounts of Fe, M, M' and Y and which does not contain nitrogen, wherein the area ratio of the fine grains in said alloy is at least 30%.

2. An Fe-based soft magnetic alloy according to claim 1, wherein the area ratio of the fine crystal gains in said alloy is at least 40%.

3. An Fe-based soft magnetic alloy according to claim 2 wherein at least 80% of said fine crystal grains are in the range of 50 Å to 300° Å.

4. An Fe-based soft magnetic alloy according to claim 1, wherein at least 80% of said fine grains are in the range of 50 Å to 300 Å.

5. An Fe-based soft magnetic alloy according to claim 1 wherein "M" is present in the range of 0.5 to 3 Atomic %.

6. An Fe-based soft magnetic alloy alloy according to claim 1 wherein the amount of "M'" is in the range of 1 to 7 Atomic %.

7. An Fe-based soft magnetic alloy according to claim 1 wherein the amount of "M'" is in the range of 1.5 to 5 Atomic %.

8. An Fe-based soft magnetic alloy according to claim 1 wherein the amount of "Y" is in the range of 18 to 26 Atomic %.

9. An Fe-based soft magnetic alloy according to claim 1, comprising Si and at least one of Bi and P such that the ratio of Si/B or the ratio Si/P is more than one.

10. An Fe-based soft magnetic alloy according to claim 1 wherein the amount of nitrogen is less than 8 Atomic %.

11. An Fe-based soft magnetic alloy as claimed in claim 13, wherein d is at least 2 atomic %.

12. An Fe-based soft magnetic alloy according to claim 1 wherein the amount of nitrogen is less than 6 Atomic %.

13. An Fe-based soft magnetic alloy as claimed in claim 14, wherein d is at least 2 atomic %.

14. An Fe-based soft magnetic alloy according to claim 1 wherein the amount of nitrogen is less than 4 atomic %.

15. An Fe-based soft magnetic alloy as claimed in claim 15, wherein d is at least 2 atomic %.

16. An Fe-based soft magnetic alloy according to claim 1, wherein at least 50% of the area ratio of said alloy is fine crystal grains.

17. A magnetic core, comprising a strip of an Fe-based soft magnetic alloy having fine crystal grains as claimed in claim 1, said strip being wound to form a toroidal core.

18. A magnetic core as claimed in claim 17, wherein said core is resin molded.

19. An Fe-based soft magnetic alloy as claimed in claim 1, wherein d is at least 2 atomic %.

20. An Fe-based soft magnetic alloy according to claim 1, wherein the area ratio of the fine grains in said alloy is at least 50%.

21. An Fe-based soft magnetic alloy according to claim 1, wherein at least 80% of said fine grains are in the range of 50 Å to 300 Å.

* * * * *